US006029674A

United States Patent [19]

Han

[11] Patent Number: 6,029,674

[45] Date of Patent: Feb. 29, 2000

[54] ADHESIVE DEVICE FOR ATTACHING A FALSE EYELASH TO AN EYELID

[76] Inventor: Yongho Han, 8 Clearmeadow Court, Woodbury, N.Y. 11797

[21] Appl. No.: 09/285,960

[22] Filed: Apr. 5, 1999

[51] Int. Cl.[7] ..... A45D 40/30

[52] U.S. Cl. ..... 132/216; 446/393

[58] Field of Search ..... 132/216, 53, 56, 132/201, 212, 215; 206/460; 446/342, 391, 393, 394

[56] References Cited

U.S. PATENT DOCUMENTS

| | | | |
|---|---|---|---|
| 2,835,259 | 5/1958 | Goodman | 132/53 |
| 3,266,500 | 8/1966 | Weld | 132/53 |
| 3,362,417 | 1/1968 | Glaser | 132/201 |
| 3,447,542 | 6/1969 | McCullough | 132/53 |
| 3,622,438 | 11/1971 | Esler | 428/375 |
| 3,885,671 | 5/1975 | Spiegel et al. | 206/460 |

*Primary Examiner*—Gene Mancene
*Assistant Examiner*—Pedro Philogene
*Attorney, Agent, or Firm*—Richard L. Miller, P.E Registered Patent Agent

[57] ABSTRACT

A device for attaching a false eyelash with an original adhesive thereon to an eyelid when the original adhesive thereon has lost its adhesion. The device includes a core and an adhesive coating that surrounds the core so as to form an attaching element. The adhesive coating attaches the core along the false eyelash and also allows the false eyelash to then be attached to the eyelid. The device further includes, a primary substrate, a secondary substrate disposed on the primary substrate and has a plurality of the attaching elements spaced longitudinally therealong and held releasibly thereon by the adhesive coating of each attaching element, a plurality of release sheet covers, each of which covers and protects an associated attaching element, prior to use, and is held releasibly thereon by the adhesive coating of the associated attaching element, and at least one pair of false eyelashes disposed on the primary substrate.

7 Claims, 1 Drawing Sheet

FIG.5
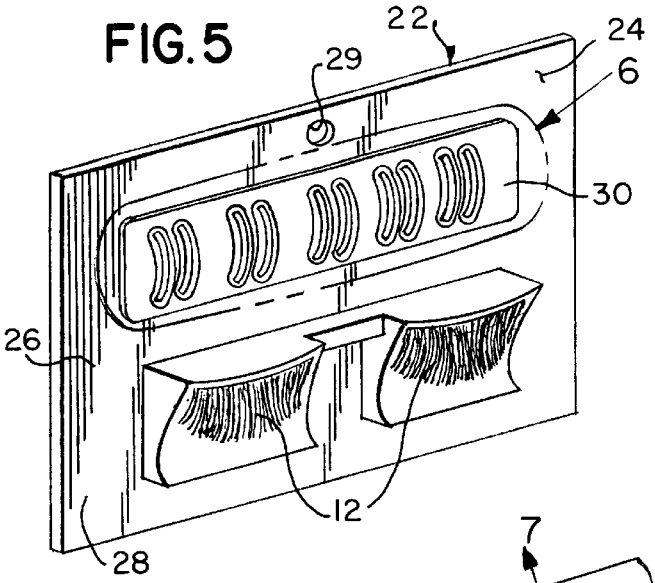
FIG.4
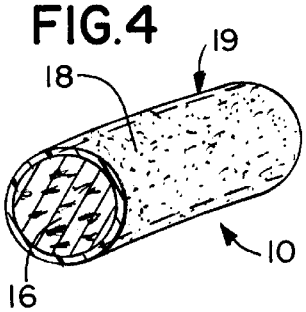
FIG.6
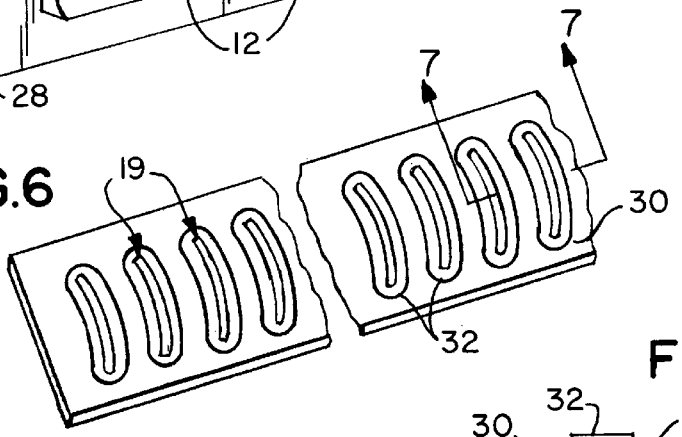
FIG.7
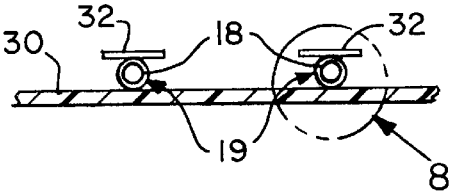
FIG.8
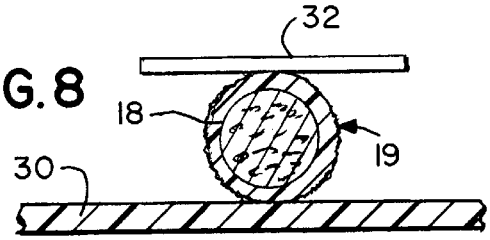
FIG.1
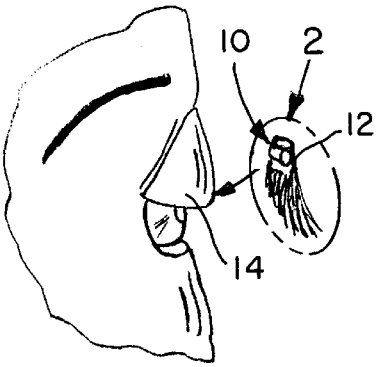
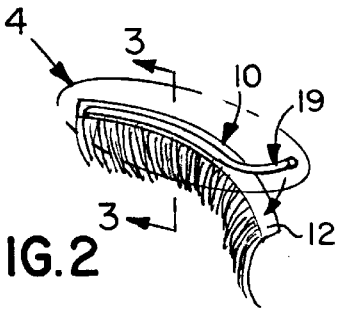
FIG.2
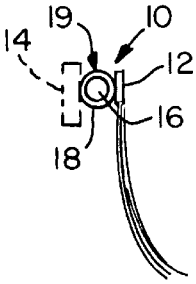
FIG.3

ADHESIVE DEVICE FOR ATTACHING A FALSE EYELASH TO AN EYELID

BACKGROUND OF THE INVENTION

1. Field of the Invention

The present invention relates to a device for attaching a false eyelash. More particularly, the present invention relates to a device for attaching a false eyelash when the original adhesive thereon has lost its adhesion.

2. Description of the Prior Art

Numerous innovations for false eyelashes have been provided in the prior art. Even though these innovations may be suitable for the specific individual purposes to which they address, however, they differ from the present invention.

Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a device for attaching a false eyelash when the original adhesive thereon has lost its adhesion that avoids the disadvantages of the prior art.

ANOTHER OBJECT of the present invention is to provide a device for attaching a false eyelash when the original adhesive thereon has lost its adhesion that is simple and inexpensive to manufacture.

STILL ANOTHER OBJECT of the present invention is to provide a device for attaching a false eyelash when the original adhesive thereon has lost its adhesion that is simple to use.

BRIEFLY STATED, YET ANOTHER OBJECT of the present invention is to provide a device for attaching a false eyelash with an original adhesive thereon to an eyelid when the original adhesive thereon has lost its adhesion. The device includes a core and an adhesive coating that surrounds the core so as to form an attaching element. The adhesive coating attaches the core along the false eyelash and also allows the false eyelash to then be attached to the eyelid. The device further includes, a primary substrate, a secondary substrate disposed on the primary substrate and has a plurality of the attaching elements spaced longitudinally therealong and held releasibly thereon by the adhesive coating of each attaching element, a plurality of release sheet covers, each of which covers and protects an attaching element, prior to use, and is held releasibly thereon by the adhesive coating of the associated attaching element, and at least one pair of false eyelashes disposed on the primary substrate.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows:

FIG. 1 is a diagrammatic perspective view of the present invention in use;

FIG. 2 is an enlarged diagrammatic perspective view of the area generally enclosed by the dotted curve identified by arrow 2 in FIG. 1;

FIG. 3 is an enlarged diagrammatic cross sectional view taken on line 3—3 in FIG. 2;

FIG. 4 is an enlarged diagrammatic perspective view of the area generally enclosed by the dotted curve identified by arrow 3 in FIG. 2 of the present invention;

FIG. 5 is a diagrammatic perspective view of a false eyelash kit utilizing the present invention;

FIG. 6 is an enlarged diagrammatic perspective view of the area generally enclosed by the dotted curve identified by arrow o in FIG. 5;

FIG. 7 is a diagrammatic cross sectional view taken on line 7—7 in FIG. 6; and FIG. 8 is an enlarged diagrammatic cross sectional view of the are generally enclosed by the dotted curve identified by arrow 8 in FIG. 7.

LIST OF REFERENCE NUMERALS UTILIZED IN THE DRAWING

10 device for attaching a false eyelash when the original adhesive thereon has lost its adhesion of the present invention

12 false eyelash

14 eyelid

16 core

18 adhesive coating for attaching core 16 along false eyelash 12 and allowing false eyelash 12 to be attached to eyelid 14

19 attaching element

22 primary substrate

24 face of primary substrate 22

26 upper area of face 24 of primary substrate 22

28 lower area of face 24 of primary substrate 22

29 display throughbore through upper area 26 of face 24 of primary substrate 22 for hanging display

30 secondary substrate

32 plurality of release sheet covers of

DESCRIPTION OF THE PREFERRED EMBODIMENT

Referring now to the figures, in which like numerals indicate like parts, and particularly to FIG. 1, the device for attaching a false eyelash when the original adhesive thereon has lost its adhesion of the present invention is shown generally at 10 for attaching a false eyelash 12 with an original adhesive thereon to an eyelid 14 when the original adhesive thereon has lost its adhesion.

The configuration of the device for attaching a false eyelash when the original adhesive thereon has lost its adhesion 10 can best be seen in FIGS. 2–4, and as such, will be discussed with reference thereto.

The device for attaching a false eyelash when the original adhesive thereon has lost its adhesion 10 comprises a core 16 and an adhesive coating 18 surrounding the core 16 so as to form an attaching element 19.

The adhesive coating 18 is for attaching the core 16 along the false eyelash 12 and for also allowing the false eyelash 12 to then be attached to the eyelid 14.

The core 16 is elongated and slender, and is preferably a thread or a mono-filament.

The adhesive coating 18 is pressure sensitive.

The device for attaching a false eyelash when the original adhesive thereon has lost its adhesion 10 further comprises a primary substrate 22 that is a card and has a face 24 with an upper area 26 and a lower area 28.

The upper area 26 of the primary substrate 22 has a display throughbore 29 therethrough for a hanging display.

The device for attaching a false eyelash when the original adhesive thereon has lost its adhesion 10 further comprises a secondary substrate 30 that is a card and disposed on the upper area 26 of the primary substrate 22, below the display throughbore 29 therethrough so as not to interfere with hanging.

The secondary substrate 30 has a plurality of the attaching elements 19 spaced longitudinally therealong and held releasibly thereon by the adhesive coating 18 of each associated attaching element 19.

The device for attaching a false eyelash when the original adhesive thereon has lost its adhesion 10 further comprises a plurality of release sheet covers 32 that are individual and separate from each other.

Each release sheet cover 32 covers and protects an associated attaching element 19, prior to use, and is held releasibly thereon by the adhesive coating 18 of the associated attaching element 19.

The device for attaching a false eyelash when the original adhesive thereon has lost its adhesion 10 further comprises at least one pair of the false eyelash 12 that are disposed on the lower area 28 of the primary substrate 22.

It will be understood that each of the elements described above, or two or more together, may also find a useful application in other types of constructions differing from the types described above.

While the invention has been illustrated and described as embodied in a device for attaching a false eyelash when the original adhesive thereon has lost its adhesion, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for attaching a false eyelash with an original adhesive thereon to an eyelid when the original adhesive thereon has lost its adhesion, said device comprising:

a) a core; and b) an adhesive coating surrounding said core so as to form an attaching element; said adhesive coating for attaching said core along the false eyelash and for also allowing the false eyelash to then be attached to the eyelid; further comprising a primary substrate having a face with:

i) an upper area; and ii) a lower area, wherein said primary substrate is a card, wherein said upper area of said primary substrate has a display throughbore therethrough for a hanging display; further comprising a secondary substrate disposed on said upper area of said primary substrate, below said display throughbore therethrough so as to not to interfere with hanging, wherein said secondary substrate has a plurality of said attaching elements spaced longitudinally therealong and held releasibly thereon by said adhesive coating of each said attaching element.

2. The device as defined in claim 1, wherein said core is elongated and slender.

3. The device as defined in claim 1, wherein said core is a thread.

4. The device as defined in claim 1, wherein said core is a mono-filament.

5. The device as defined in claim 1, wherein said adhesive coating is pressure sensitive.

6. The device as defined in claim 1, further comprising a plurality of release sheet covers being individual and separate from each other.

7. The device as defined in claim 6, wherein each release sheet cover covers and protects an associated attaching element, prior to use, and is held releasibly thereon by said adhesive coating of said associated attaching element.

* * * * *